US005450656A

United States Patent [19]

Ueding et al.

[11] Patent Number: 5,450,656

[45] Date of Patent: Sep. 19, 1995

[54] FLAT CAN

[75] Inventors: Michael Ueding; Jürgen Sauer, both of Ingolstadt, Germany

[73] Assignee: Rieter Ingolstadt Spinnereimaschinenbau AG, Ingolstadt, Germany

[21] Appl. No.: 128,606

[22] Filed: Sep. 29, 1993

[30] Foreign Application Priority Data

Oct. 15, 1992 [DE] Germany ..... 42 34 793.9

[51] Int. Cl.[6] ..... D04H 11/00

[52] U.S. Cl. ..... 19/159 R; 206/388

[58] Field of Search ..... 19/159 R, 159 A; 57/281, 90; 220/220, 8; 206/388, 393

[56] References Cited

U.S. PATENT DOCUMENTS

| | | | |
|---|---|---|---|
| 2,018,261 | 10/1935 | Holdsworth | 19/159 R |
| 2,947,595 | 8/1960 | Moelter | 19/159 R |
| 3,302,955 | 2/1967 | Witzgall . | |
| 3,612,457 | 10/1971 | Morikawa | 19/159 A |
| 4,261,079 | 4/1981 | Masini et al. | 19/159 R |
| 5,237,726 | 8/1993 | Gartenmann et al. | 19/159 R |
| 5,276,947 | 1/1994 | Fritschi et al. . | |

FOREIGN PATENT DOCUMENTS

| | | | |
|---|---|---|---|
| 255880 | 2/1988 | European Pat. Off. | 19/159 R |
| 344484 | 12/1989 | European Pat. Off. | 19/159 R |
| 335621 | 2/1904 | France . | |
| 401522 | 9/1924 | Germany | 19/159 R |
| 823599 | 12/1963 | Germany . | |
| 2300992 | 9/1974 | Germany . | |
| 2428730 | 12/1975 | Germany . | |
| 3717647A1 | 12/1988 | Germany . | |
| 22934 | 1/1914 | United Kingdom | 19/159 R |
| 986355 | 3/1965 | United Kingdom . | |
| 1171529 | 11/1969 | United Kingdom | 19/159 R |
| 1379022 | 1/1975 | United Kingdom | 19/159 R |
| 1138378 | 2/1985 | U.S.S.R. | 19/159 A |
| 1362700 | 12/1987 | U.S.S.R. | 19/159 R |

*Primary Examiner*—Clifford D. Crowder
*Assistant Examiner*—Michael A. Neas
*Attorney, Agent, or Firm*—Dority & Manning

[57] ABSTRACT

A flat can for receiving textile fiber slivers deposited therein while a jigging motion is imparted thereto comprises can sides defining an upper can bead at the top thereof. A can plate is configured to be vertically movable within the can sides between an empty position and a full position. In the empty position the can plate is at a height lower than the upper can bead. The can plate may comprise a rim around the circumference thereof which has a top generally adjacent to the upper can bead when the can plate is at the empty position. The rim may include oppositely facing incline surfaces at the ends thereof. The can sides may also include stops defined on the inner surface thereof. The stops serve to define the upper limit of travel of the can plate within the can.

9 Claims, 4 Drawing Sheets

FLAT CAN

BACKGROUND OF THE INVENTION

The invention relates to a flat can to receive a fiber sliver delivered by carders or draw frames. The flat can serves as a container to receive the delivered fiber sliver as well as for its transportation to a spinning mill machine for further processing by means of which the fiber sliver is taken out of the flat can. Flat cans have the advantage over round cans that they can be set up and transported in a more space-saving manner. In addition, more fiber sliver can be stored in a flat can than in a corresponding round can. The problem, by comparison with the round can, is however the filling and the emptying of the flat can, as the quality of the fiber sliver must not be affected in any way.

Known flat cans consist of 2 long, parallel sides and 2 faces. All sides are perpendicular to the bottom of the can (EP 344 484).

The cross-section of the flat can may be rectangular in shape, rectangular with rounded corners (EP 344 484), rectangular with rounded end elements (DE-OS 40 15 938, FIG. 3A) or oval. The can plate which, as is known, is movable and is lowered or raised in function of the fullness of the flat can, also assumes the same form. As is shown in EP 344484, it was customary for flat cans to position the can plate at the level of the can's rim in the empty state. Positioning is achieved by means of springs. The pantograph causes the can plate to always remain horizontal during its up or down movement. However, high jigging speeds nevertheless cause tilting of the can plate.

When the flat can is being filled with fiber sliver it is normally moved back and forth in the longitudinal sense of the can underneath the filling device so that this jigging movement causes the fiber sliver to be deposited on the can plate cycloidically, going from one face of the flat can to the other face. As filling increases, several deposited fiber sliver layers constitute a sliver column which, as a result of its own weight, slowly lowers the can plate to the stop at the can bottom. The can plate has a border which forms an angle down towards the standing surface (can bottom) as is also normally the case with other cans, and reaches as far as the can sides, leaving only a small gap. According to the state of the art (EP 344 484) the can plate is supported at each of its two ends by a helicoidal spring which position the can plate at the upper can rim when it is not burdened.

As soon as the first fiber sliver layer is formed on the can plate, the sliver loop nearest to the front is clearly being displaced in the direction of the can front. This local displacement results from the braking and acceleration forces occurring as the jigging movement reverses. This uncontrolled displacement of the fiber sliver leads to the disadvantage that the sliver loop is pressed over the rim of the can at the front while the first layer is being formed. This displacement increases with the delivery speeds, so that the utilization of flat cans affects the production speed of the carder or of the draw frame. This also applies to the subsequent layers of fiber sliver, even if the displacement is attenuated due to increased adhesive friction between the layers.

This displacement not only affects the quality of the fiber slivers at the front of the can, but the disturbed deposit of the fiber sliver also results in difficulties when the fiber sliver is later withdrawn from the flat can.

The positioning of the can plate according to EP 457 099 (Column 7, lines 41 to 44) even assumes that the can plate should be positioned even slightly higher than the upper can rim, i.e. near the lower rim of the rotary plate of the carder or of the drawing frame. In this manner a required contact pressure is achieved even for the first layers of the fiber sliver. But this has the disadvantage that the can plate of the flat can grinds against the rotary plate immediately at the beginning of the filling action. Wear of the rotary plate surfaces affects the fiber sliver to be deposited.

As the height of the fiber sliver column which consists of a plurality of fiber sliver layers laying on top of each other increases, its mass also increases. In particular as the flat can reaches the reversal points of the jigging movement, this has the effect that due to its mass inertia, the fiber sliver column sways towards the face which is then toward the front. The entire fiber sliver column sways in that case. This swaying is an interference, since it influences the fiber sliver deposit which is still continuing. This not only leads to changes in density of the fiber sliver near the face opposite the depositing positions, but it may also occur that the fiber sliver loops at the front slip into the gap between fiber sliver column and can side due to the swaying of the fiber sliver column and become wedged, an occurrence which increases sliver breakage during subsequent sliver withdrawal. The swaying of the fiber sliver column furthermore produces an undesirable force moment taking effect upon the can side and the can plate.

To counteract this disadvantage, EP 344 484, FIGS. 1 and 2 proposes to install a pantograph (also called a slidable lattice grate or lazy tongs) on the insides of each of the longitudinal side walls to ensure a parallel guidance of the can plate in relation to the sides. However this requires additional design outlay which still is not certain to avoid a tilted position of the can plate when the jigging speeds of the flat can are high.

The pantographs which face each other symmetrically at the longitudinal rims of the can plate cannot prevent a tendency of the can plate of tilting in the direction of its longitudinal axis at high jigging speeds. The danger of jamming against the sides also exists. Tilting of the can plate also has the disadvantage that single, suddenly stressed helicoidal spring, may buckle away from its vertical axis.

The above-mentioned problems have prevented the introduction of the flat can in practical application in the past because the delivery speeds which are normal with the round can could not be achieved.

OBJECTS AND SUMMARY OF THE INVENTION

It is a principal object of the instant invention to achieve correct sliver deposit as a jigging flat can is being filled, making it also possible to withdraw the sliver faultlessly, and this at economically sound depositing speeds such as are possible with round cans. Additional objects and advantages of the invention will be set forth in part in the following description, or may be obvious from the description, or may be learned through practice of the invention.

It is a characteristic of the invention that the can plate is provided with a bottom which is lower than the can rim in empty position. The depth of the lower position in relation to the can rim is approximately equal to the thickness of two fiber sliver layers laying on top of each other. In this manner the fiber sliver loops are prevented from being displaced as far as over the rim of the can at the beginning of the filling operation. The angle-forming rim of the can plate points in the direction of the upper rim of the can and is positioned against the can sides. This can rim which forms an upward angle reaches approximately as far as the upper can rim. It is however also possible for the angle-forming rim of the can plate to form an angle in the direction of the standing surface of the can and to be also parallel to the can sides. In this case the can plate is held against a stop below the upper can rim when the flat can is empty. The stop is positioned on the can side so that the can plate is held in the lowered position in relation to the can rim.

Another advantageous embodiment consists in the two end segments of the can plate to be inclined in the form of surfaces toward the middle segment. The inclination of these surfaces can be changed and set. This embodiment makes it possible for the contact pressure of the fiber sliver against the rotary plate to occur sooner at the end segments than in the middle segment. Displacement of the sliver loops is also avoided in this manner.

A further characteristic of the invention is the fact that the surface of the can plate is structured so that adhesive friction against the fiber sliver is increased.

These technical characteristics make it possible to obtain the advantage that first fiber sliver layers are not displaced on the can plate during filling as the jigging movement takes place and thus to achieve a clean deposit of the slivers in the desired cycloid form over the entire length of the can plate.

It is a further characteristic of the invention that the sides of the flat can are corrugated in proximity of the upper rim or over their entire surface. This corrugation of the sides produces a great number of resistance points which lead to additional and therefore increased adhesive friction between the fiber sliver column and the can sides. It is possible to attenuate the swaying of the fiber sliver column due to mass inertia by means of this simple design measure. It has furthermore the advantage of increased rigidity of the sides to resist bending.

It is a further advantage of the flat can that only one pantograph is now installed between the two helicoidal springs which are installed near the face walls. This single pantograph is centered in relation to the can bottom and horizontal struts are provided in the crossing points of this pantograph, said struts being rotatably mounted in each crossing point. The ends of the struts are articulatedly connected to the facing helicoidal spring. Buckling of the helicoidal spring out of its vertical position as may result from swaying of the fiber column is thus avoided in all positions of the can plate and at high jigging speeds.

DETAILED DESCRIPTION OF THE PREFERRED EMBODIMENTS

Figure 1:
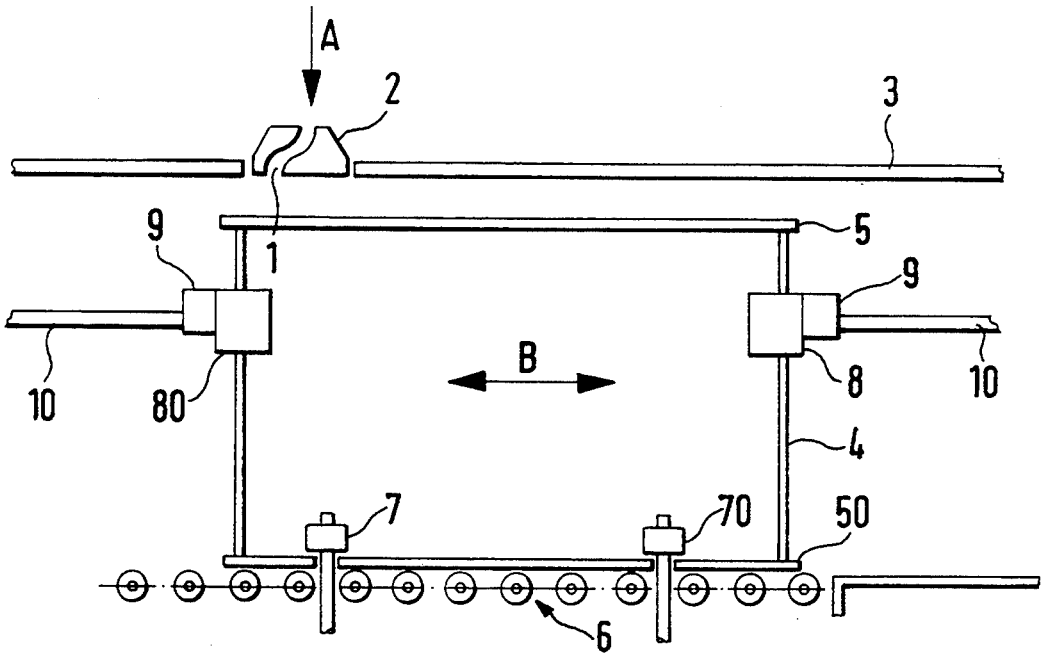
FIG. 1 illustrates a flat can in an jigging device of a draw frame.

Reference will now be made in detail to the presently preferred embodiments of the invention, one or more examples of which are illustrated in the drawing. Each example is provided by way of explanation of the invention, and not as a limitation of the invention. The number of components is consistent throughout the description and drawings, with the same components having the same numbers throughout.

According to FIG. 1, the fiber sliver is conveyed from the draw frame to the rotary plate 2. The conveying direction A of the fiber sliver is shown by the arrow. The rotary plate 2 rotates with its outlet of the sliver guiding channel 1 in a stationary position and is surrounded by a machine table 3. The fiber sliver leaves the outlet in the rotary plate 2 and is deposited in cycloidal form in the flat can 4. The depositing of the fiber sliver is not shown. Each individual layer of the fiber sliver is deposited over the entire width and length of the can plate. The can plate is installed at the can side in such manner as to be capable of movement. As the number of fiber sliver layers increases, the can plate must be able to descend in the direction of the can standing surface. The movement of the can plate may be carried out by means of an externally controlled lifting mechanism which is located below the can plate. The lifting mechanism is here engaged with the can plate.

Another possibility is to provide springs below the can plate, said springs going from a starting position (empty flat can) into a lowered position as a function of the burdening of the can plate.

A full flat can is conveyed to a spinning machine for further processing of the sliver. The width of a flat can is therefore equal to the working width of the individual spinning station. The flat can 4 may have a rectangular or oval area. A rectangular area with rounded corners is preferred. The flat can 4 moved back and forth (jigged) in the longitudinal direction (as indicated by double arrow B) under the rotary plate 2 of a draw frame or carder so that the can plate (not shown in FIG. 1) is covered with fiber sliver over its entire length. To be able to jig the flat can 4, it is placed with its lower can bead 50 on a roller track 6. The roller track 6 consists of a plurality of freely moving rollers which are located next to each other and correspond at least to the jigging path. The flat can 4 is jigged on this roller track 6. On both sides at the lateral limits of the roller track 6, and at a distance from each other, are guide rollers 7 and 70 (as a rule more than two per side) which guide the flat can 4 in the area where they stand. During the jigging period the flat can is grasped in its upper third (below the lower can bead 5) on both sides by jigging holders 8 and 80, whereby the jigging holders are connected to a carriage 9. This carriage 9 is provided with a drive which is not shown here. The drive is controlled according to a program for the filling of the flat can 4. The carriage 9 is guided along rail 10.

Figure 2:
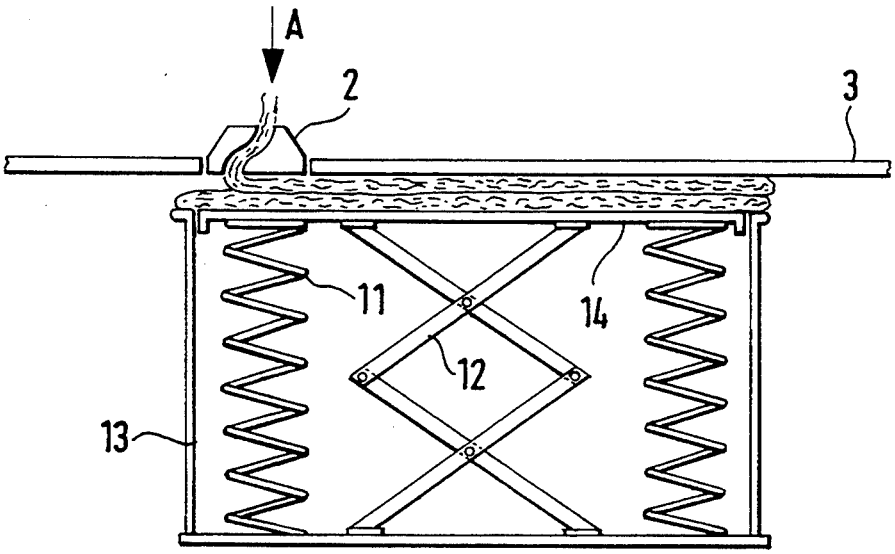
FIG. 2 illustrates positioning of the fiber sliver in the area of the front sides in known flat cans.

FIG. 2 documents the can design known in the past from EP 344 484 as it appears within the can sides 13 and below the can plate 14. A helicoidal spring 11 is provided for each and a pantograph 12 on the long sides.

The flat can is moved back and forth, i.e. jigged. The jigging speed at the reversal point is braked to value zero and acceleration to jigging speed is attained immediately upon passing the reversal point. A similar process of braking and acceleration occurs at the facing reversal paint. Due to braking and acceleration, the forward sliver loop is displaced over the can rim (see FIG. 2) in the known flat cans after the first fiber sliver layers are constituted. This is very disadvantageous, in particular at the high jigging speeds. Since the can plate 14 is at the same level as the can rim or slightly higher in known cans as shown in FIG. 2, displacement of the forward sliver loop is even more pronounced. In practice it has been shown that the contact pressure of the fiber sliver against the rotary plate intended by the raised can plate is not sufficient to hold the sliver loops within range of the forward side of the flat can.

This design of the can plate and its placement (FIG. 2) eludes the formation of uniform fiber sliver layers and later impedes the withdrawal of the fiber sliver from the flat can. The danger of sliver breakage exists.

Figure 3A:
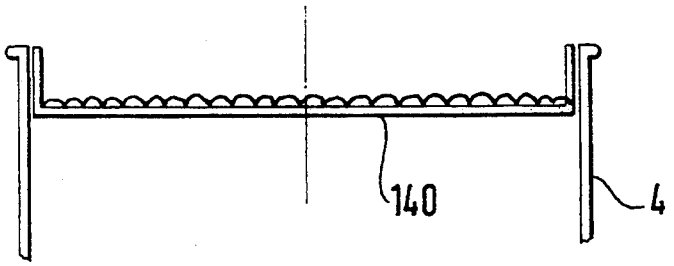
FIG. 3*a* is a side view of the can plate of a flat can.

In order to avoid the displacement of the first fiber sliver layers during alternation of the flat can, the can plate is lowered over its entire length in relation to the can rim (upper can bead 5). This is shown in FIG. 3*a*. The depth by which the can plate 140 is lowered in relation to the can rim is approximately equal to the thickness of two fiber sliver layers lying on top of each other.

Thanks to this lowering, the first two sliver layers cannot be pressed over the rim of the can but are held by the sides in their deposited position. Since a narrow gap must be maintained between the can plate and the can sides to ensure the mobility of the can plate, parts of the fiber sliver loop may be wedged in. In order to avoid such wedging it is proposed that the can plate 140 be angled upwards. The angle-forming surface constitutes a rim. The rim is parallel with the sides of the flat can and ends close to and below the upper can rim (FIG. 3*a*).

Figure 5:
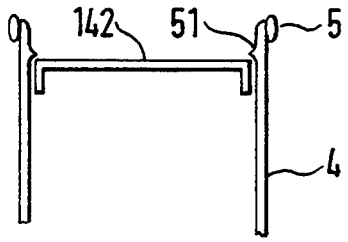
FIG. 5 is a view of a side of a flat can with a stop for the can plate.

FIG. 5 shows the lowered position of a can plate 142, with the lower position being constrained by the stop 51. Stop 51 is located on the inside wall below the upper can bead 5. As the can plate 142 is lifted, the stop 51 always keeps it below the upper can bead 5. Stop 51 is not an additional component but it is advantageously possible to take it into account when forming the sides of the can.

Figure 3B:
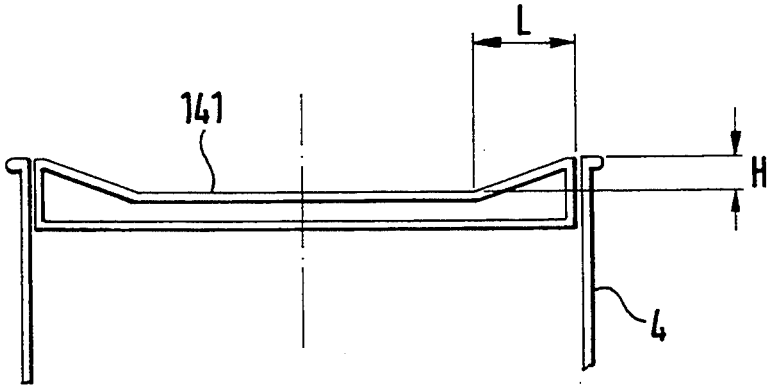
FIG. 3*b* is a side view of another embodiment of the can plate of a flat can.

An embodiment of the can plate is however also possible in which the two end segments of the can plate are angled along an inclined plane (FIG. 3*b*). It is however also possible to use surfaces with a slight spherical camber. The length L of each of the two inclined planes is equal to the depositing radius of the cycloidically deposited fiber sliver. The height H of this inclined plane is equal to a sufficiently small clearance between the upper rim of the can and the flat portion of the can plate 141 such as it is provided when filling begins. The inclined planes in the end segments of the can plate cause the first fiber sliver layer and the ones which follow immediately to be pressed against the machine table 3 earlier and with greater force in this area than the remaining layers in the central segment. The increased pressure of the fiber sliver layers between can plate 141 and machine table 3 in the end segments of the can plate prevent displacement of the fiber slivers.

Figure 3C:
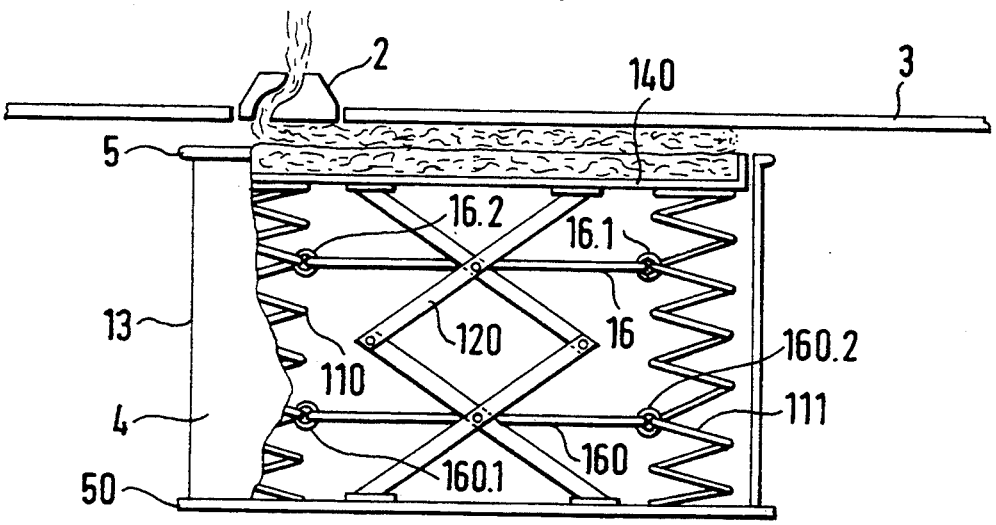
FIG. 3*c* is a design of a flat can.
Figure 3D:
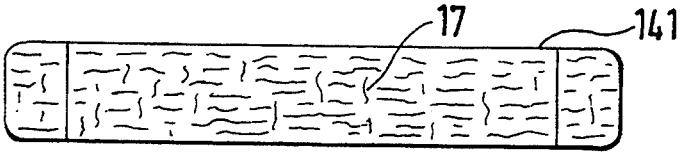
FIG. 3*d* is a top view of the can plate of a flat can.

In order to further increase adhesion between fiber sliver layers and can plate, the can plate is given a structured surface 18 (FIG. 3*d*). However, a design with a knobby surface is also possible.

FIG. 3*c* shows the internal structure of a flat can according to the invention. The can plate 140 is supported by one single pantograph which is located centrally below the can bottom 140. In the crossing points of the pantograph, struts 16, 160 are provided in horizontal position and are mounted rotatably in their respective crossing points. The ends of the struts are articulatedly connected to the annular springs 110, 111 facing them. The articulated connection is achieved by making the ends of the struts (16, 160) in form of eyelets (16.1, 16.2; 160.1; 160.2). Buckling of the helicoidal spring out of its vertical position, such as has occurred in the past as a result of swaying of the fiber sliver column, is thus avoided in any position of the can plate and at high jigging speeds.

Figure 4:
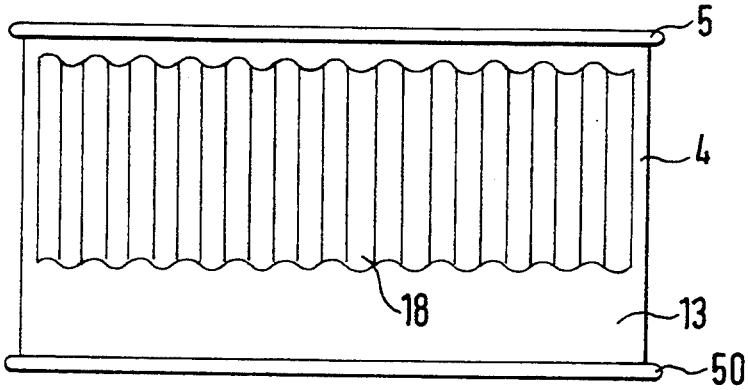
FIG. 4 is a view of a side of a flat can.

As the deposit of the fiber sliver increases, the can plate is pushed down as a result of the fiber sliver weight. From the plurality of fiber sliver layers a fiber sliver column tending to sway is formed because of its mass inertia at the reversal points of the jigging movement. Swaying produces forces which act upon the jigging support. In order to attenuate this swaying of the fiber sliver column during alternation of the flat can, the sides are corrugated in proximity of the upper rim (upper can bead 5). The entire side surface may however also be corrugated. Corrugation 18 is such that corrugation peaks and valleys point in the direction of the perpendicular to the supporting surface of the can, i.e. in the direction of the lower rim (FIG. 4). Another design is however also possible, i.e. with corrugation peaks and valleys running parallel to the upper and lower rims of the side wall. The corrugation 18 produces many points of resistance which lead to increased frictional connection between the fiber sliver column and the can sides. The advantage is that swaying of the fiber sliver column is reduced.

Figure 6:
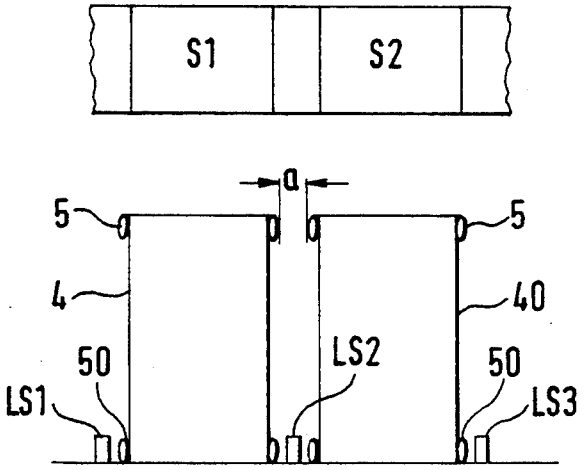
FIG. 6 is a flat can with known, lower can bead.
Figure 7:
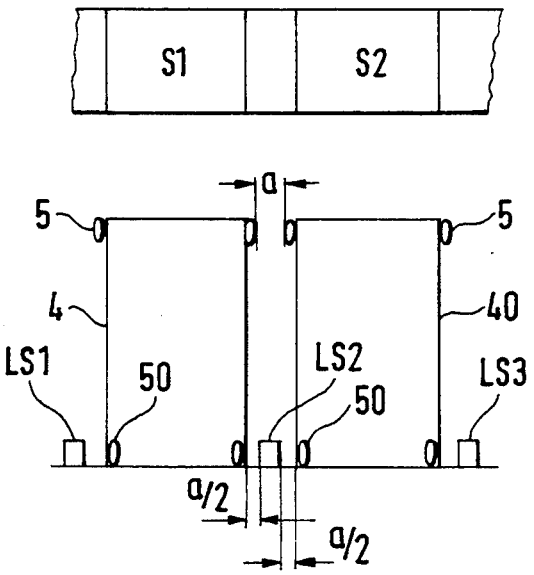
FIG. 7 is a flat can with new arrangement of the lower can bead.

As shown earlier, the flat can 4 has an upper can bead 5 and a lower can bead 50. Upper and lower can beads 5, 50 extend as is known for the same distance laterally over the can sides. This known condition is documented by FIG. 6. A partial view shows flat cans 4 and 40 standing respectively beneath spinning stations S1 and S2. Each flat can has approximately the width of a spinning station, with a small lateral distance a remaining between the juxtaposed flat cans 4, 40. Since this lateral distance is a small one, and in order to facilitate the replacement of cans, guide rails are provided on the standing surface of the spinning machine and are shown partially as guide rails LS1, LS2 and LS3. These guide rails shorten the lateral distance a in the area under the can bead 50. When cans are replaced the flat can may become wedged in since the tolerance of the lateral distance a is too narrow, and this may slow down can replacement. For this reason the flat can is designed so that the lower can bead 50 is placed on the inside (FIG. 7). As a result the flat can is wider at the upper can bead 5 than at the lower can bead 50. A distance which is approximately equal to one half of the lateral distance a is created by this measure between the guide rail and the lower can bead. This makes it possible to increase the tolerance in the area of the guide rails so that wedging of the flat can during replacement is avoided. FIG. 7 shows the configuration of the flat can according to the invention in the area of the lower can bead 50.

It will be apparent to those skilled in the art that various modifications and variations can be made in the present invention without departing from the scope or spirit of the invention. For example, features illustrated or described as part of one embodiment can be used on another embodiment to yield a still further embodiment. Thus, it is intended that the present invention cover such modifications and variations as come within the scope of the appended claims and their equivalents.

We claim:

1. A flat can configured for receiving textile fiber slivers while having a jigging motion imparted thereto, said flat can comprising can sides defining an upper can bead at the top thereof, a can plate configured to be vertically movable within said can sides between an empty position and a full position, said can sides further comprising at least one stop defined on the inner surface thereof, said stops disposed at a height below said upper can bead, the upper limit of travel of said can plate defined by the position of said stops, said can further comprising a pantograph disposed between springs operatively configured below said can plate, and at least one connecting member connecting said springs and said pantograph.

2. A flat can configured for receiving textile fiber slivers while having a jigging motion imparted thereto, said flat can comprising can sides defining an upper can bead at the top thereof, a can plate configured to be vertically movable within said can sides between an empty position and a full position, said can further comprising a pantograph disposed between helicoidal springs operatively configured below said can plate, and at least one strut connecting said springs and connected to said pantograph at a crossing point thereof.

3. The flat can as in claim 2, further comprising a plurality of said struts connecting said springs.

4. The flat can as in claim 2, wherein said struts are connected to facing circumferential surfaces of said springs.

5. The flat can as in claim 2, wherein said springs are disposed in end zones of said can.

6. The flat can as in claim 4, wherein said struts are connected to said springs through eyelets disposed at the ends thereof.

7. The flat can as in claim 2, wherein said can sides further comprise corrugated surfaces.

8. The flat can as in claim 7, wherein said can sides are corrugated in the proximity of said upper can bead.

9. The flat can as in claim 8, wherein the apex lines of the corrugations in said can sides are perpendicular to a plane through said upper can bead.

* * * * *